US007144497B2

(12) United States Patent
Lok et al.

(10) Patent No.: US 7,144,497 B2
(45) Date of Patent: Dec. 5, 2006

(54) BLENDING OF LOW VISCOSITY FISCHER-TROPSCH BASE OILS WITH CONVENTIONAL BASE OILS TO PRODUCE HIGH QUALITY LUBRICATING BASE OILS

(75) Inventors: Brent K. Lok, San Francisco, CA (US); David Kramer, San Anselmo, CA (US); John M. Rosenbaum, Richmond, CA (US); Joseph Pudlak, Vallejo, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 695 days.

(21) Appl. No.: 10/301,391

(22) Filed: Nov. 20, 2002

(65) Prior Publication Data

US 2004/0094453 A1 May 20, 2004

(51) Int. Cl.
*C10M 105/02* (2006.01)
*C10G 71/00* (2006.01)

(52) U.S. Cl. ..... 208/18; 208/19; 585/1; 585/2

(58) Field of Classification Search ..... 208/18, 208/19; 585/1, 2
See application file for complete search history.

(56) References Cited

U.S. PATENT DOCUMENTS

| | | | |
|---|---|---|---|
| 2,668,790 | A | 2/1954 | Good et al. |
| 2,668,866 | A | 2/1954 | Good et al. |
| 4,812,246 | A | 3/1989 | Yabe |
| 4,906,350 | A | 3/1990 | Lucien et al. |
| 5,135,638 | A | 8/1992 | Miller |
| 6,008,164 | A | 12/1999 | Aldrich et al. |
| 6,059,955 | A | 5/2000 | Cody et al. |
| 6,080,301 | A | 6/2000 | Berlowitz et al. |
| 6,090,989 | A | 7/2000 | Trewella et al. |
| 6,096,940 | A | 8/2000 | Wittenbrink et al. |
| 6,165,949 | A | 12/2000 | Berlowitz et al. |
| 6,332,974 | B1 | 12/2001 | Wittenbrink et al. |
| 6,392,109 | B1 | 5/2002 | O'Rear et al. |
| 6,475,960 | B1 | 11/2002 | Berlowitz et al. |
| 6,627,779 | B1 | 9/2003 | O'Rear |

FOREIGN PATENT DOCUMENTS

| | | | |
|---|---|---|---|
| EP | 0 515 256 | B1 | 3/1997 |
| EP | 0 776 959 | A3 | 6/1997 |
| JP | 63309592 A 19881216 | | 12/1988 |
| JP | 10053788 A 19980224 | | 2/1998 |
| WO | WO 93/14049 | | 7/1993 |
| WO | WO 99/41335 | | 8/1999 |
| WO | WO 00/08115 | | 2/2000 |
| WO | WO 00/14179 | | 3/2000 |
| WO | WO 00/14187 | | 3/2000 |
| WO | WO 01/57166 | A1 | 8/2001 |
| WO | WO 02/070629 | A1 | 9/2002 |
| WO | WO 2004/003113 | A1 | 1/2004 |

OTHER PUBLICATIONS

"Platforming of Paraffin Wax", Journal of the Institute of Petroleum, 1956, vol. 43, pp. 205-216 by Schenk et al., University of Chemical Engineering, Delft.

"Hydro-Isomerization of Paraffin Wax", Journal of the Institute of Petroleum, vol. 43, No. 407, pp. 297-306, Nov. 1957 by Breimer et al., University of Chemical Engineering, Delft, Holland.

*Primary Examiner*—Tam M. Nguyen
(74) *Attorney, Agent, or Firm*—Steven H. Roth

(57) ABSTRACT

A process for producing a lubricating base oil blend which comprises (a) recovering a Fischer-Tropsch derived distillate fraction characterized by a kinematic viscosity of about 2 cSt or greater but less than 3 cSt at 100 degrees C.; and (b) blending the Fischer-Tropsch derived distillate fraction with a petroleum derived base oil selected from the group consisting of a Group I base oil, a Group II base oil, a Group III base oil, and a mixture of two or more of any of the foregoing conventional base oils in the proper proportion to produce a lubricating base oil blend characterized as having a viscosity of about 3 or greater; also the base oil blends, finished lubricants, and their use in internal combustion engines.

17 Claims, No Drawings

BLENDING OF LOW VISCOSITY FISCHER-TROPSCH BASE OILS WITH CONVENTIONAL BASE OILS TO PRODUCE HIGH QUALITY LUBRICATING BASE OILS

FIELD OF THE INVENTION

The invention relates to the blending of a low viscosity Fischer-Tropsch derived base oil fraction with a higher viscosity conventional petroleum derived base oil fraction to produce a high quality lubricating base oil that is useful for preparing commercial finished lubricants such as crankcase engine oils.

BACKGROUND OF THE INVENTION

Finished lubricants used for automobiles, diesel engines, axles, transmissions, and industrial applications consist of two general components, a lubricating base oil and additives. Lubricating base oil is the major constituent in these finished lubricants and contributes significantly to the properties of the finished lubricant. In general, a few lubricating base oils are used to manufacture a wide variety of finished lubricants by varying the mixtures of individual lubricating base oils and individual additives.

Numerous governing organizations, including original equipment manufacturers (OEM's), the American Petroleum Institute (API), Association des Consructeurs d' Automobiles (ACEA), the American Society of Testing and Materials (ASTM), and the Society of Automotive Engineers (SAE), among others, define the specifications for lubricating base oils and finished lubricants. Increasingly, the specifications for finished lubricants are calling for products with excellent low temperature properties, high oxidation stability, and low volatility. Currently, only a small fraction of the base oils manufactured today are able to meet these demanding specifications.

Syncrude prepared from the Fischer-Tropsch process comprise a mixture of various solid, liquid, and gaseous hydrocarbons. Those Fischer-Tropsch products which boil within the range of lubricating base oil contain a high proportion of wax which makes them ideal candidates for processing into lubricating base oil stocks. Accordingly, the hydrocarbon products recovered from the Fischer-Tropsch process have been proposed as feedstocks for preparing high quality lubricating base oils. When the Fischer-Tropsch waxes are converted into Fischer-Tropsch base oils by various processes, such as by hydroprocessing and distillation, the base oils produced fall into different narrow-cut viscosity ranges. Typically, the kinematic viscosity of the various cuts will range between 2.1 cSt and 12 cSt at 100 degrees C. Since the kinematic viscosity of lubricating base oils typically will fall within the range of from 3 to 32 cSt at 100 degrees C., the base oils that fall below 3 cSt at 100 degrees C. have limited use and, consequently, have less market value.

The Fischer-Tropsch process typically produces a syncrude mixture containing a wide range of products having varying molecular weights but with a relatively high proportion of the products characterized by a low molecular weight and viscosity. Therefore, usually only a relatively low proportion of the Fischer-Tropsch products will have viscosities above 3 cSt at 100 degrees C. which would be useful directly as lubricating base oils for the manufacture of commercial lubricants, such as engine oil. Currently, those Fischer-Tropsch derived base oils having kinematic viscosities below 3 cSt at 100 degrees C. have a limited market and are usually blended or cracked into lighter products, such as diesel and naphtha. However, diesel and naphtha have a lower market value than lubricating base oil. It would be desirable to be able to upgrade these low viscosity base oils into products suitable for use as a lubricating base oil.

Conventional base oils prepared from petroleum derived feedstocks having a kinematic viscosity below 3 cSt at 100 degrees C. have a low viscosity index (VI) and high volatility. Consequently, low viscosity conventional base oils are unsuitable for blending with higher viscosity conventional base oils because the blend will fail to meet the VI and volatility specifications for a lubricating base oil. Surprisingly, it has been found that Fischer-Tropsch derived base oils having a kinematic viscosity above 2 and below 3 cSt at 100 degrees C. have exceptionally low volatilities due to their extremely high VI's. Even more surprising was that when the low viscosity Fischer-Tropsch derived distillate fraction was blended with certain higher viscosity petroleum derived lubricating base oils, a VI premium was observed, i.e., the VI of the blend was significantly higher than would have been expected from a mere averaging of the VI's for the two fractions. In addition, due to the inherent oxidation stability of the Fischer-Tropsch derived base oils, finished lubricants prepared from blends containing them will generally require lower amounts of antioxidant additives and will be less likely to form insoluble oxidation products which result in the presence of sludge and deposits. Also due to the excellent UV stability of the Fischer-Tropsch derived base oils, the finished lubricants usually will require the addition of less UV stabilizers than needed with conventionally derived lubricating base oils. Finally, the Fischer-Tropsch derived distillate fraction is characterized by very low total sulfur which makes them excellent candidates for upgrading conventional petroleum derived base oils which typically contain between 10 and 5000 ppm total sulfur. Since the highest total sulfur usually will be found in the heaviest fractions derived from conventional oils, the present process is especially useful for upgrading heavy conventionally derived petroleum fractions. Consequently, it is has been discovered that the low viscosity Fischer-Tropsch derived base oils may be advantageously employed as blending stock with higher viscosity conventional petroleum derived base oils to prepare premium lubricating base oils and finished lubricants.

While lubricating base oil blends containing Fischer-Tropsch derived base oils have been described in the prior art, the method used to prepare the lubricating base oils and the properties of the prior art blends differ from the present invention. See, for example, U.S. Pat. Nos. 6,332,974; 6,096,940; 4,812,246; and 4,906,350. Specifically, it has not been previously taught that Fischer-Tropsch fractions having a kinematic viscosity of less than 3 cSt at 100 degrees C. can be blended with conventional petroleum derived base oils to prepare lubricating base oils suitable for blending finished lubricants meeting the specifications for SAE Grade 0W, 5W, 10W, and 15W multi-grade engine oils; SAE 70W, 75W, and 80W gear lubricants; and ISO Viscosity Grade 22, 32, and 46 industrial oils. With the present invention, this becomes possible.

When referring to conventional lubricating base oils, this disclosure is referring to conventional petroleum derived lubricating base oils produced using petroleum refining processes well documented in the literature and known to those skilled in the art.

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" are intended as a transition meaning the exclusion of all but the recited elements with the exception of only minor traces of impurities.

SUMMARY OF THE INVENTION

The present invention is directed to a process for producing a lubricating base oil blend which comprises (a) recovering a Fischer-Tropsch derived distillate fraction characterized by a kinematic viscosity of about 2 cSt or greater but less than 3 cSt at 100 degrees C.; and (b) blending the Fischer-Tropsch derived distillate fraction with a petroleum derived base oil selected from the group consisting of a Group I base oil, a Group II base oil, a Group III base oil, and a mixture of two or more of any of the foregoing conventional base oils in the proper proportion to produce a lubricating base oil blend characterized as having a viscosity of about 3 or greater. Using the process of the invention lubricating base oils have been prepared which meet the specifications for a premium lubricating base oil. The invention makes it possible to upgrade low viscosity Fischer-Tropsch derived base oils into more valuable premium lubricants which otherwise would be cracked into lower value transportation fuels.

The Fisher-Tropsch derived distillate fraction will typically comprise from about 10 weight percent to about 80 weight percent of the total lubricating base oil blend. The petroleum derived base oil will comprise from about 20 weight percent to about 90 weight percent of the total blend. The lubricating base oil blends of the present invention will have a kinematic viscosity of about 3 cSt or greater. Typically, the lubricating base oil blends prepared according to the invention will have a TGA Noack volatility of greater than about 12 and more generally will have a TGA Noack volatility in excess of about 20. However when the lubricating base oil contains a high ratio of heavy neutral base oil or bright stock, the Noack volatility may be lower than 12 depending upon the amount of the heavy material present. The blends also typically will display a VI of at least 90, preferably of at least 100. The lubricating base oils of the invention usually will have good low temperature properties. For example, pour points of less than about −12 degrees C. are typical. However, one skilled in the art will recognize that the properties of the lubricating base oil blend will depend upon factors such as the ratio of the Fischer-Tropsch derived distillate fraction to the petroleum derived base oil present in the total blend and the properties of the petroleum derived base oil.

The lubricating base oils of the present invention may be used to prepare a finished lubricant, such as, for example, a commercial multi-grade crankcase lubricating oil meeting SAE J300, June 2001 specifications, by the addition of the proper additives. Accordingly, the invention is also directed to a process for preparing a finished lubricant which comprises adding at least one additive to a lubricating base oil blend which is comprised of from about 10 to about 80 weight percent of a Fischer-Tropsch derived distillate fraction characterized by a viscosity of about 2 cSt or greater but less than 3 cSt at 100 degrees C. and from about 20 to about 90 weight percent of a petroleum derived base oil selected from the group consisting of a Group I base oil, a Group II base oil, and a mixture of Group I and Group II base oils.

Typical additives added to a lubricating base oil when preparing a finished lubricant include anti-wear additives, detergents, dispersants, antioxidants, pour point depressants, VI improvers, friction modifiers, demulsifiers, antifoaming agents, corrosion inhibitors, seal swell agents, and the like. In addition, commercial products meeting SAE standards for gear lubricants and ISO Viscosity Grade standards for industrial oils may be prepared from the lubricating base oils of the invention. Multi-grade crankcase engine oils meeting the SAE J300, June 2001 specifications for a 10W and 15W grade engine oil may be formulated from the lubricating base oils of the invention. More specifically, multi-grade crankcase engine oils meeting the SAE J300, June 2001 specifications for 10W-40, 15W-30, and 15W-40 grade engine oils have been formulated from the lubricating base oils of the invention.

Multi-grade crankcase engine oils prepared from the lubricating base oils of the invention are highly stable and usually will display Oxidator B values of greater than 15 hours. Multi-grade crankcase oil prepared from lubricating base oils of the invention may be formulated to meet the SAE J300 specification for cold cranking viscosity (CCS) and the maximum gelation index specified by the API SJ and the ILSAC GF-3 Service Categories for Engine Oils.

In addition, the invention is directed to a method for operating an internal combustion engine having a valve train, the internal combustion engine using a normally liquid or gaseous fuel, wherein the method comprises lubricating the internal combustion engine, including the valve train, with a finished lubricant which comprises (a) a lubricating base oil blend which is comprised of from about 10 to about 80 weight percent of a Fischer-Tropsch derived distillate fraction characterized by a viscosity of about 2 cSt or greater but less than 3 cSt at 100 degrees C. and from about 20 to about 90 weight percent of a petroleum derived base oil selected from the group consisting of a Group I base oil, a Group II base oil, and a mixture of Group I and Group II base oils, and (b) at least one additive.

DETAILED DESCRIPTION OF THE INVENTION

Fischer-Tropsch wax processing typically produces a relatively high proportion of products of low molecular weight and low viscosity that are processed into light products such as naphtha, gasoline, diesel, fuel oil, or kerosene. A relatively small proportion of products have viscosities above 3.0 cSt which are useful directly as lubricating base oils for many different products, including engine oils. Those base oils with viscosities below 3 cSt typically are blended or further processed into lighter products (e.g., gasoline or diesel) in order to be of much economic value. Alternatively, these low viscosity Fischer-Tropsch derived base oils may be used in light industrial oils, such as, for example, utility oils, spindle oils, pump oils, or hydraulic oils, spray oils, process oils, or diluent oils; all of which are in much lower demand than engine oils.

Lubricating base oils for use in engine oils are in higher demand than the light products. The ability to use a higher proportion of the products from Fischer-Tropsch processes in lubricating base oil blends for engine oils is highly desirable. By virtue of the present invention, Fischer-Tropsch derived lubricating base oils characterized by low viscosity are blended with medium or high viscosity conventional petroleum derived distillate fractions to produce compositions which are useful as lubricating base oils for preparing engine oil. Due to the relatively low volatility of the Fischer-Tropsch derived base oils as compared to conventionally derived base oils of similar viscosity, the volatility and viscosity of the blend is comparable to Group I and Group II Neutral oils prepared entirely from petroleum derived feedstocks. In addition, since the Fischer-Tropsch derived base oils have low total sulfur and good oxidation stability as compared to conventional base oils, the lubricating base oils of the present invention also have improved properties when compared to conventional lubricating base oils.

As noted above, lubricating base oils and commercial finished lubricants prepared from the lubricating base oils are required to meet certain minimum specifications established by various governing organizations. Petroleum derived base oils having a kinematic viscosity of less than 3 cSt are considered unsuitable for preparing engine lubricating base oils because blends containing them are generally unable to meet these engine oil specifications. Therefore, it is unexpected that Fischer-Tropsch derived fractions having a kinematic viscosity of about 2 cSt or greater but less than 3 cSt at 100 degrees C. may be used to prepare lubricating base oils meeting these requirements.

Lubricating base oils of the invention may be used to formulate either mono-grade or multi-grade crankcase engine oils. A mono-grade crankcase engine oil refers to an engine oil that has a viscosity which falls within the limits specified for a single SAE number in SAE J300. A mono-grade crankcase engine oil has no low temperature requirements. A multi-grade crankcase engine oil refers to an engine oil that has viscosity/temperature characteristics which fall within the limits of two different SAE numbers in SAE J300.

Cold-cranking simulator (CCS) apparent viscosity of automotive engine oils correlates with low temperature cranking. It is measured by ASTM D5293 at a set temperature between −5 and −30 degrees C. Engine oil specifications, e.g., SAE J300, include maximum limits for CCS Viscosity for multi-grade engine oils.

The Gelation Index which is measured by ASTM D 5133 is a number indicating the oil's tendency to form a gelated structure in the oil at colder temperatures. Numbers above 6 indicate some gelation-forming tendencies. Numbers above 12 are of concern to engine makers. This is the maximum value for API SJ and ILSAC GF-3 Service Categories for Engine Oils.

High temperature high shear rate viscosity (HTHS) is a measure of a fluid's resistance to flow under conditions resembling highly-loaded journal bearings in fired internal combustion engines, typically 1 million $s^{-1}$ at 150° C. HTHS is a better indication of how an engine operates at high temperature with a given lubricant than the kinematic low shear rate viscosities at 100° C. The HTHS value directly correlates to the oil film thickness in a bearing. SAE J300 June '01 contains the current specifications for HTHS measured by either ASTM D 4683, ASTM D 4741, or ASTM D 5481.

The specifications for 10W grade premium engine oils are shown in Table 1 below.

TABLE 1

| SAE J300/API SJ | SAE 10W-30 | SAE 10W-40 |
|---|---|---|
| Viscosity at 100° C., cSt | 4.1–12.5 | 4.1–16.3 |
| CCS, cP | 7000 max @ −25 | 7000 max @ −25 |
| HTHS | 2.9 min | 2.9 min |
| Scanning Brookfield Gelation Index | 12 max | 12 max |

The specifications for 15W grade premium engine oils are shown in Table 2 below.

TABLE 2

| SAE J300/API SJ | SAE 15W-30 | SAE 15W-40 |
|---|---|---|
| Viscosity at 100° C., cSt | 5.6–12.5 | 5.6–16.3 |
| CCS, cP | 7000 max @ −20 | 7000 max @ −20 |
| HTHS | 2.9 min | 3.7 min |
| Scanning Brookfield Gelation Index | 12 max | 12 max |

Multi-grade engine oils meeting the specifications for both 10W and 15W premium grade engine oils as shown in Tables 1 and 2 have been formulated with the lubricating base oils of the present invention.

Noack volatility is defined as the mass of oil, expressed in weight percent, which is lost when the oil is heated at 250 degrees C. and 20 mmHg (2.67 kPa; 26.7 mbar) below atmospheric in a test crucible through which a constant flow of air is drawn for 60 minutes (ASTM D-5800). A more convenient method for calculating Noack volatility and one which correlates well with ASTM D-5800 is by using a thermo gravimetric analyzer test (TGA) by ASTM D-6375. TGA Noack volatility is used throughout this disclosure unless otherwise stated. Noack volatility of engine oil, as measured by TGA Noack and similar methods, has been found to correlate with oil consumption in passenger car engines. Strict requirements for low volatility are important aspects of several recent engine oil specifications, such as, for example, ACEA A-3 and B-3 in Europe and ILSAC GF-3 in North America. Due to the high volatility of conventional low viscosity oils with kinematic viscosities below 3 cSt at 100 degrees C., they have limited their use in passenger car engine oils. Any new lubricating base oil stocks developed for use in automotive engine oils should have a volatility no greater than current conventional Group I or Group II Light Neutral oils. Lubricating base oils prepared according to the present invention generally will have a volatility within these ranges.

Fischer-Tropsch Synthesis

During Fischer-Tropsch synthesis liquid and gaseous hydrocarbons are formed by contacting a synthesis gas (syngas) comprising a mixture of hydrogen and carbon monoxide with a Fischer-Tropsch catalyst under suitable temperature and pressure reactive conditions. The Fischer-Tropsch reaction is typically conducted at temperatures of from about 300 degrees to about 700 degrees F. (about 150 degrees to about 370 degrees C.) preferably from about 400 degrees to about 550 degrees F. (about 205 degrees to about 230 degrees C.); pressures of from about 10 to about 600 psia, (0.7 to 41 bars) preferably 30 to 300 psia, (2 to 21 bars) and catalyst space velocities of from about 100 to about 10,000 cc/g/hr., preferably 300 to 3,000 cc/g/hr.

The products from the Fischer-Tropsch synthesis may range from $C_1$ to $C_{200}$ plus hydrocarbons with a majority in the $C_5$–$C_{100}$ plus range. The reaction can be conducted in a variety of reactor types, such as, for example, fixed bed reactors containing one or more catalyst beds, slurry reactors, fluidized bed reactors, or a combination of different types of reactors. Such reaction processes and reactors are well known and documented in the literature. The slurry Fischer-Tropsch process, which is preferred in the practice of the invention, utilizes superior heat (and mass) transfer characteristics for the strongly exothermic synthesis reaction and is able to produce relatively high molecular weight, paraffinic hydrocarbons when using a cobalt catalyst or cobalt in combination with other metals. In the slurry process, a syngas comprising a mixture of hydrogen and carbon monoxide is bubbled up as a third phase through a slurry which comprises a particulate Fischer-Tropsch type hydrocarbon synthesis catalyst dispersed and suspended in a slurry liquid comprising hydrocarbon products of the synthesis reaction which are liquid under the reaction conditions. The mole ratio of the hydrogen to the carbon monoxide may broadly range from about 0.5 to about 4, but is more typically within the range of from about 0.7 to about 2.75 and preferably from about 0.7 to about 2.5. A particularly preferred Fischer-Tropsch process is taught in European Patent Application No. 0609079, also completely incorporated herein by reference for all purposes.

Suitable Fischer-Tropsch catalysts comprise one or more Group VIII catalytic metals such as Fe, Ni, Co, Ru and Re, with cobalt being preferred. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania or mixtures thereof. Preferred supports for cobalt containing catalysts comprise titania. Useful catalysts and their preparation are known and illustrated in U.S. Pat. No. 4,568,663, which is intended to be illustrative but non-limiting relative to catalyst selection.

The Fischer-Tropsch derived products generally contain a high proportion of wax. Therefore, prior to blending the Fischer-Tropsch distillate fraction with the petroleum derived base oil, it is usually desirable to first isomerizes the wax in order to improve its flow properties. Other processing steps used in preparing the Fischer-Tropsch distillate fraction may include solvent dewaxing, atmospheric and vacuum distillation, hydrocracking, hydrotreating, hydrofinishing, and other forms of hydroprocessing.

Hydroisomerization and Solvent Dewaxing

Hydroisomerization, or for the purposes of this disclosure simply "isomerization", is intended to improve the cold flow properties of the product by the selective addition of branching into the molecular structure. Isomerization ideally will achieve high conversion levels of the wax to non-waxy iso-paraffins while at the same time minimizing the conversion by cracking. Since wax conversion can be complete, or at least very high, this process typically does not need to be combined with additional dewaxing processes to produce a lubricating oil base stock with an acceptable pour point. Isomerization operations suitable for use with the present invention typically uses a catalyst comprising an acidic component and may optionally contain an active metal component having hydrogenation activity. The acidic component of the catalysts preferably includes an intermediate pore SAPO, such as SAPO-11, SAPO-31, and SAPO41, with SAPO-11 being particularly preferred. Intermediate pore zeolites, such as ZSM-22, ZSM-23, SSZ-32, ZSM-35, and ZSM48, also may be used in carrying out the isomerization. Typical active metals include molybdenum, nickel, vanadium, cobalt, tungsten, zinc, platinum, and palladium. The metals platinum and palladium are especially preferred as the active metals, with platinum most commonly used.

The phrase "intermediate pore size", when used herein, refers to an effective pore aperture in the range of from about 4.8 to about 7.1 Angstrom when the porous inorganic oxide is in the calcined form. Molecular sieves having pore apertures in this range tend to have unique molecular sieving characteristics. Unlike small pore zeolites such as erionite and chabazite, they will allow hydrocarbons having some branching into the molecular sieve void spaces. Unlike larger pore zeolites such as faujasites and mordenites, they are able to differentiate between n-alkanes and slightly branched alkenes, and larger alkanes having, for example, quaternary carbon atoms. See U.S. Pat. No. 5,413,695. The term "SAPO" refers to a silicoaluminophosphate molecular sieve such as described in U.S. Pat. Nos. 4,440,871 and 5,208,005.

In preparing those catalysts containing a non-zeolitic molecular sieve and having an hydrogenation component, it is usually preferred that the metal be deposited on the catalyst using a non-aqueous method. Non-zeolitic molecular sieves include tetrahedrally-coordinated [AIO2] and PO2] oxide units which may optionally include silica. See U.S. Pat. No. 5,514,362. Catalysts containing non-zeolitic molecular sieves, particularly catalysts containing SAPO's, on which the metal has been deposited using a non-aqueous method have shown greater selectivity and activity than those catalysts which have used an aqueous method to deposit the active metal. The non-aqueous deposition of active metals on non-zeolitic molecular sieves is taught in U.S. Pat. No. 5,939,349. In general, the process involves dissolving a compound of the active metal in a non-aqueous, non-reactive solvent and depositing it on the molecular sieve by ion exchange or impregnation.

Solvent dewaxing attempts to remove the waxy molecules from the product by dissolving them in a solvent, such as methyl ethyl ketone, methyl iso-butyl ketone, or toluene, or precipitating the wax molecules as discussed in Chemical Technology of Petroleum, 3rd Edition, William Gruse and Donald Stevens, McGraw-Hill Book Company, Inc., New York, 1960, pages 566–570. See also U.S. Pat. Nos. 4,477,333; 3,773,650; and 3,775,288. In general, with the present invention isomerization is usually preferred over solvent dewaxing, since it results in higher yields of the products. However solvent dewaxing may be advantageously used in combination with isomerization to recover unconverted wax following isomerization.

Hydrotreating, Hydrocracking, and Hydrofinishing

Hydrotreating refers to a catalytic process, usually carried out in the presence of free hydrogen, in which the primary purpose is the removal of various metal contaminants, such as arsenic; heteroatoms, such as sulfur and nitrogen; or aromatics from the feed stock. Generally, in hydrotreating operations cracking of the hydrocarbon molecules, i.e., breaking the larger hydrocarbon molecules into smaller hydrocarbon molecules is minimized, and the unsaturated hydrocarbons are either fully or partially hydrogenated. Hydrocracking refers to a catalytic process, usually carried out in the presence of free hydrogen, in which the cracking of the larger hydrocarbon molecules is the primary purpose of the operation. During hydrocracking hydrogen is added to the molecules and the boiling range of the feed is reduced. Desulfurization and/or denitrification of the feedstock also usually will occur.

Catalysts used in carrying out hydrotreating and hydrocracking operations are well known in the art. See for example U.S. Pat. Nos. 4,347,121 and 4,810,357, the contents of which are hereby incorporated by reference in their entirety, for general descriptions of hydrotreating, hydrocracking, and of typical catalysts used in each of the processes. Suitable catalysts include noble metals from Group VIIIA (according to the 1975 rules of the International Union of Pure and Applied Chemistry), such as platinum or palladium on an alumina or siliceous matrix, and unsulfided Group VIIIA and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. Nos. 4,157,294 and 3,904,513. The non-noble hydrogenation metals, such as nickel-molybdenum, are usually present in the final catalyst composition as oxides, or more preferably or possibly, as sulfides when such compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. Catalysts containing noble metals, such as platinum, contain in excess of 0.01 percent metal, preferably between 0.1 and 1.0 percent metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e.; molybdenum and tungsten can be combined with the refractory oxide by impregnation, co-mulling or co-precipitation. During actual operation, these components can be employed as their sulfides, oxides, or in their reduced form.

The matrix component can be of many types including some that have acidic catalytic activity. Ones that have acidity include amorphous silica-alumina or may be a zeolitic or non-zeolitic crystalline molecular sieve. Examples of suitable matrix molecular sieves include zeolite Y, zeolite X and the so called ultra stable zeolite Y and high structural silica:alumina ratio zeolite Y such as that described in U.S. Pat. Nos. 4,401,556; 4,820,402; and 5,059,567. Small crystal size zeolite Y, such as that described in U.S. Pat. No. 5,073,530 can also be used. Non-zeolitic molecular sieves which can be used include, for example, silicoaluminophosphates (SAPO), ferroaluminophosphate, titanium aluminophosphate and the various ELAPO molecular sieves described in U.S. Pat. No. 4,913,799 and the references cited therein. Details regarding the preparation of various non-zeolite molecular sieves can be found in U.S. Pat. Nos. 5,114,563 (SAPO) and U.S. Pat. No. 4,913,799 and the various references cited in U.S. Pat. No. 4,913,799. Mesoporous molecular sieves can also be used, for example the M41 S family of materials as described in *J. Am. Chem. Soc.*, 114:10834–10843(1992)), MCM-41; U.S. Pat. Nos. 5,246,689; 5,198,203; and 5,334,368; and MCM-48 (Kresge et al., *Nature* 359:710 (1992)). Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or derived from gelatinous precipitates or gels including mixtures of silica and metal oxides. Naturally occurring clays which can be composited with the catalyst include those of the montmorillonite and kaolin families. These clays can be used in the raw state as originally mined or initially subjected to dealumination, acid treatment or chemical modification.

In performing the hydrocracking and/or hydrotreating operation, more than one catalyst type may be used in the reactor. The different catalyst types can be separated into layers or mixed.

Hydrocracking conditions have been well documented in the literature. In general, the overall LHSV is about 0.1 $hr^{-1}$ to about 15.0 $hr^{-1}$ (v/v), preferably from about 0.25 $hr^{-1}$ to about 2.5 $hr^{-1}$. The reaction pressure generally ranges from about 500 psig to about 3500 psig (about 3.5 MPa to about 24.1 MPa), preferably from about 1000 psig to about 2500 psig (about 6.9 MPa to about 17.2 MPa). Hydrogen consumption is typically from about 500 to about 2500 SCF per barrel of feed (89.1 to 445 $m^3$ H2/$m^3$ feed). Temperatures in the reactor will range from about 400 degrees F. to about 950 degrees F. (about 204 degrees C. to about 510 degrees C.), preferably ranging from about 650 degrees F. to about 850 degrees F. (about 343 degrees C. to about 454 degrees C.).

Typical hydrotreating conditions vary over a wide range. In general, the overall LHSV is about 0.25 to 3.0, preferably about 0.5 to 2.0. The hydrogen partial pressure is greater than 200 psia, preferably ranging from about 300 psia to about 2000 psia. Hydrogen recirculation rates are typically greater than 50 SCF/Bbl, and are preferably between 500 and 5000 SCF/Bbl. Temperatures in the reactor will range from about 300 degrees F. to about 750 degrees F. (about 150 degrees C. to about 400 degrees C.), preferably ranging from 450 degrees F. to 600 degrees F. (230 degrees C. to about 315 degrees C.).

Hydrotreating may also be used as a final step in the lube base oil manufacturing process. This final step, commonly called hydrofinishing, is intended to improve the UV stability and appearance of the product by removing traces of aromatics, olefins, color bodies, and solvents. As used in this disclosure, the term UV stability refers to the stability of the lubricating base oil or the finished lubricant when exposed to UV light and oxygen. Instability is indicated when a visible precipitate forms, usually seen as floc or cloudiness, or a darker color develops upon exposure to ultraviolet light and air. A general description of hydrofinishing may be found in U.S. Pat. Nos. 3,852,207 and 4,673,487. Clay treating to remove these impurities is an alternative final process step.

Distillation

The separation of the Fischer-Tropsch derived products into various fractions is generally accomplished by either atmospheric or vacuum distillation or by a combination of atmospheric and vacuum distillation. Atmospheric distillation is typically used to separate the lighter distillate fractions, such as naphtha and middle distillates, from a bottoms fraction having an initial boiling point above about 700 degrees F. to about 750 degrees F. (about 370 degrees C. to about 400 degrees C.). At higher temperatures thermal cracking of the hydrocarbons may take place leading to fouling of the equipment and to lower yields of the heavier cuts. Vacuum distillation is typically used to separate the higher boiling material, such as the lubricating base oil fractions.

As used in this disclosure, the term "distillate fraction" or "distillate" refers to a side stream product recovered either from an atmospheric fractionation column or from a vacuum column as opposed to the "bottoms" which represents the residual higher boiling fraction recovered from the bottom of the column.

The Fischer-Tropsch Distillate Fraction

The Fischer-Tropsch distillate fraction used to prepare the lubricating base oil product of the invention represents that portion of the Fischer-Tropsch derived product having a viscosity of about 2 or greater but less than 3 cSt at 100 degrees C., more preferably between about 2.1 and 2.8 cSt at 100 degrees C., and most preferably between about 2.2 and 2.7 cSt at 100 degrees C. As already noted, despite the low kinematic viscosity of the Fischer-Tropsch derived distillate fraction, the Noack volatility is very low compared to that for a petroleum derived conventional Group I and Group II base oil of equivalent viscosity.

The Fischer-Tropsch distillate fraction used in the invention typically are prepared using the various processing steps discussed in detail above, i.e., Fischer-Tropsch synthesis, hydrotreating, hydrocracking, catalytic hydroisomerization dewaxing, hydrofinishing, atmospheric distillation, and vacuum distillation.

The Petroleum Derived Base Oil

The petroleum derived base oil blended with the Fischer-Tropsch derived distillate fraction used to prepare the lubricating base oil of the invention will comprise a Group I, Group II, or a Group III base oil or a blend containing a mixture of two or more the foregoing conventional base oils. As used herein a Group I base oil refers to a petroleum derived lubricating base oil having a total sulfur content of greater than 300 ppm, less than 90 weight percent saturates, and a viscosity index (VI) of between 80 and 120. Group II base oil refers to a petroleum derived lubricating base oil having a total sulfur content equal to or less than 300 ppm, saturates which are equal to or more than 90 weight percent, and a VI of between 80 and 120. The Group III base oils have less than 300 ppm sulfur, saturates greater than 90 weight percent, and Vi's of 120 or greater. The Group I or Group II base oil comprise light overhead cuts and heavier side cuts from a vacuum distillation column and include, for example, Light Neutral, Medium Neutral, and Heavy Neutral base stocks. The petroleum derived base oil also may include residual stocks or bottoms fractions, such as, for example, bright stock. Bright stock is a high viscosity base oil which has been conventionally produced from residual stocks or bottoms and has been highly refined and dewaxed. It is named for the SUS viscosity at 210° F. Bright stock has a kinematic viscosity above 180 cSt at 40° C., more preferably above 250 cSt at 40° C., and still more preferably ranging from about 500 to 1100 cSt at 40° C. Blending heavy neutral or bright stock with the Fischer-Tropsch derived distillate fraction is a preferred embodiment of the invention, since the resulting lubricating base oil will have especially low volatility, good cold flow properties, and improved oxidation stability as compared to many conventional base oils.

With the exception of Fischer-Tropsch synthesis all of the various processing steps discussed in detail above also may be employed to prepare the desired petroleum derived base oil used in the invention.

Lubricating Base Oil

Lubricating base oils are base oils having a viscosity greater than 3 cSt at 100 degrees C.; a pour point below 20 degrees C., preferably below −12 degrees C.; and a VI that is usually greater than 90, preferably greater than 100. As explained below and illustrated in the examples, the lubricating base oils prepared according to the process of the present invention meet these criteria. In addition, the lubricating base oils of the invention display a unique combination of properties which could not have been predicted from a review of the prior art relating to both conventional and Fischer-Tropsch materials. The invention takes advantage of the high VI of the Fischer-Tropsch distillate fraction which when blended with the petroleum derived base oil will result in a final blend having a viscosity which is within acceptable limits for a lubricating base oil.

In preparing the lubricating base oil of the invention, the Fischer-Tropsch derived distillate fraction and the petroleum derived base oils are usually blended together to achieve a target viscosity. Depending upon the viscosities of the different components, the proportions of the various fractions in the blend will need to be adjusted accordingly. One skilled in the art will recognize that any number of different petroleum derived fractions may be blended into the lubricating base oil so long as the kinematic viscosity remains within the target viscosity range selected for the final blend.

Pour point is the temperature at which a sample of the lubricating base oil will begin to flow under carefully controlled conditions. In this disclosure, where pour point is given, unless stated otherwise, it has been determined by standard analytical method ASTM D-5950. Lubricating base oils prepared according to the present invention have excellent pour points which are comparable or even below the pour points observed for conventionally derived lubricating base oils.

Due to the extremely low aromatics and multi-ring naphthene levels of blends of Fischer-Tropsch derived distillate fraction, the lubricating base oils of the invention will have an oxidation stability which will generally exceed that of conventional lubricating base oil blends. A convenient way to measure the stability of lube base oils is by the use of the Oxidator Test, as described by Stangeland et al. in U.S. Pat. No. 3,852,207. There are two forms of this test: Oxidator BN and Oxidator B. The Oxidator BN test measures the resistance to oxidation by means of a Dornte-type oxygen absorption apparatus. See R. W. Dornte "Oxidation of White Oils," Industrial and Engineering Chemistry, Vol. 28, page 26, 1936. Normally, the conditions are one atmosphere of pure oxygen at 340 degrees F. The results are reported in hours to absorb 1000 ml Of $O_2$ by 100 g. of oil. In the Oxidator BN test, 0.8 ml of catalyst is used per 100 grams of oil and an additive package is included in the oil. The catalyst is a mixture of soluble metal-naphthenates simulating the average metal analysis of used crankcase oil. The additive package is 80 millimoles of zinc bispolypropylenephenyldithiophosphate per 100 grams of oil. The Oxidator BN measures the response of a base oil or finished lubricant in a simulated application. High values, or long times to adsorb one liter of oxygen, indicate good stability. Generally, the Oxidator BN should be above about 7 hours. For the present invention, the Oxidator BN value will be greater than about 15 hours, preferably greater than about 25 hours, and most preferably greater than about 30 hours. The Oxidator B test is conducted in the same fashion, except the additive package is omitted.

In general, lubricating base oils of the invention will have a Noack volatility of between about 12 weight percent and about 45 weight percent unless the blend contains an especially high proportion of heavy conventional petroleum derived base oil, such as heavy neutral or bright stock. In this instance the volatility may be less than 12 weight percent.

In the present invention, the Fisher-Tropsch derived distillate fraction will comprise from about 10 weight percent to about 80 weight percent of the total lubricating base oil blend. The petroleum derived base oil will comprise from about 20 weight percent to about 90 weight percent of the total blend. When a heavy petroleum derived base oil, such as heavy neutral oil or bright stock, is used in preparing the blend, less conventional base oil generally is required to achieve the desired properties of the lubricating base oil blend than if a lighter material is incorporated into the blend. With lighter weight petroleum derived base oil, such as Medium Neutral base oil, the petroleum derived base oil will typically comprise from about 40 weight percent to about 90 weight percent of the final blend. In this instance, the Fischer-Tropsch derived distillate fraction will comprise from about 10 weight percent to about 60 weight percent of the final blend.

Preferably, the boiling range distribution of the lubricating base oils of the invention will be significantly broader than those observed for lubricating base oils comprising only conventional petroleum derived base oils. The boiling range distribution for conventionally derived lubricating base oils typically will not exceed about 250 degrees F. (about 139 degrees C.). The boiling range distribution of the lubricating base oil blend of the invention will vary with the weight of the petroleum derived base oil and the ratio of the petroleum derived base oil to the Fischer-Tropsch derived distillate fraction. For example, when the petroleum derived base oil is a medium neutral base oil, the ratio of the Fischer-Tropsch derived distillate fraction to the medium neutral base oil will be such that the boiling range distribution preferably will be greater than 250 degrees F. When the petroleum derived base oil is a heavy neutral base oil, the ratio of the Fischer-Tropsch derived distillate fraction to the heavy neutral base oil preferably will be such that the boiling range distribution will be greater than 350 degrees F. Finally, when the petroleum derived base oil is brightstock, the ratio of the Fischer-Tropsch derived distillate fraction to the brightstock preferably will be such that the boiling range distribution will be greater than 450 degrees F. In this disclosure when referring to boiling range distribution, the boiling range between the 5 percent and 95 percent boiling points is what is referred to. All boiling range distributions in this disclosure are measured using the standard analytical method D-6352 or its equivalent unless stated otherwise. As used herein, a equivalent analytical method to D-6352 refers to any analytical method which gives substantially the same results as the standard method.

As already noted, when the low viscosity Fischer-Tropsch derived distillate fraction was blended with the petroleum derived lubricating base oils, a viscosity index (VI) premium was observed. The term "VI premium" refers to a VI boost in which the VI of the blend is significantly higher than would have been expected from a mere averaging of the VI's for the two fractions. This effect was most noticeable when a heavier petroleum derived base oil was used in the blend.

Finished Lubricants

Finished lubricants generally comprise a lubricating base oil and at least one additive. Finished lubricants are used in automobiles, diesel engines, axles, transmissions, and numerous other transportation and industrial applications. As noted above, finished lubricants must meet the specifications for their intended application as defined by the concerned governing organization. Lubricating base oils of the present invention have been found to be suitable for formulating finished lubricants intended for many of these applications. For example, lubricating base oils of the present invention may be formulated to meet SAE J300, June 2001 specifications for both mono-grade and multi-grade crankcase engine oils. For example, multi-grade crankcase engine oil meeting the specifications for 0W-XX, 5W-XX, 10W-XX, and 15W-XX multi-grade crankcase lubricating oils may be formulated. In addition, Fischer-Tropsch derived lubricating base oils of the invention may be used to formulate finished lubricants meeting the specifications for SAE 70W, 75W and 80W gear lubricants and ISO Viscosity Grade 22, 32, and 46 industrial oils.

Finished lubricants within the scope of the invention should have a cold-cranking simulator (CCS) apparent viscosity of less than 7000 cP at −25 degrees C. and preferably of 6500 cP or less at −25 degrees C. if the lubricant is intended for use in an automobile engine. The Gelation Index should not exceed 12 and preferably will be 6 or less.

The lubricating base oil compositions of the invention may also be used as a blending component with other oils. For example, the lubricating base oils of the invention may be used as a blending component with synthetic base oils, including polyalpha-olefins, diesters, polyol esters, or phosphate esters, to improve the viscosity and viscosity index properties of those oils. Lubricating base oils of the invention may be combined with isomerized petroleum wax. They may also be used as process oils, diluent oils, workover fluids, packer fluids, coring fluids, completion fluids, and in other oil field and well-servicing applications. For example, they can be used as spotting fluids to release a drill pipe which has become stuck, or they can be used to replace part or all of the expensive polyalphaolefin lubricating additives in downhole applications. Additionally, lubricating base oils of the invention may be used in drilling fluid formulations where shale-swelling inhibition is important, such as described in U.S. Pat. No. 4,941,981.

Additives which may be blended with the lubricating base oil to form the finished lubricant composition include those which are intended to improve certain properties of the finished lubricant. Typical additives include, for example, anti-wear additives, detergents, dispersants, antioxidants, pour point depressants, VI improvers, friction modifiers, demulsifiers, antifoaming agents, corrosion inhibitors, seal swell agents, and the like. Other hydrocarbons, such as those described in U.S. Pat. Nos. 5,096,883 and 5,189,012, may be blended with the lubricating base oil provided that the finished lubricant has the necessary pour point, kinematic viscosity, flash point, and toxicity properties. Typically, the total amount of additives in the finished lubricant will fall within the range of from about 1 to about 30 weight percent. However due to the excellent properties of the Fischer-Tropsch derived base oils present in the blend, less additives than required with conventional base oils derived entirely from petroleum stocks may be required to meet the specifications for the finished lubricant. For example, due to the inherent stability of the Fischer-Tropsch distillate fraction, lower amounts of antioxidant additives and UV stabilizers are generally required in preparing the finished lubricants. In addition, due to the excellent VI of the blends, VI target values may be achieved in some finished lubricants without the addition of viscosity improvers or with lower treat rates of viscosity improvers. The use of additives in formulating finished lubricants is well documented in the literature and well within the ability of one skilled in the art. Therefore, additional explanation should not be necessary in this disclosure.

Use in Internal Combustion Engines

As already discussed, the lubricating base oil blends may be formulated into premium finished lubricants which are suitable for use in an internal combustion engine having a valve train. As used in this disclosure, the term internal combustion engine refers to an engine which uses a normally liquid or gaseous fuel, such as, for example, natural gas, gasoline, and diesel fuel. Fuels which may be suitable for use in internal combustion engines and which are within the scope of this invention include mineral-derived fuels, such as from petroleum, shale, or coal; synthetic fuels, such as those derived from Fischer-Tropsch synthesis; fuels derived from vegetable matter such as ethanol; as well as other fuels such as methanol, ethers, organo-nitro compounds and the like. Gasoline fuels may be either leaded or unleaded. Diesel fuels may be low sulfur diesel fuels, i.e., diesel fuels containing less than about 0.05 weight percent sulfur.

Internal combustion engines include gasoline piston engines and diesel engines. The engine may be either of the two-stroke or four-stroke design. The finished lubricants of the invention are used to lubricate the various engine parts, including the cylinder walls, bearings, and the valve train, i.e., the valves and the camshaft. In automobile engines the valve train is generally one of two designs, the overhead valve design and the overhead cam design.

The internal combustion engine may include a turbocharger which as used herein refers to an exhaust driven pump that compresses the intake air and forces it into the combustion chambers at higher than atmospheric pressure. The internal combustion engine also may include an exhaust gas after-treatment device, such as a catalytic converter or particulate trap, which is intended to reduce pollutants in the engine exhaust

EXAMPLES

The following examples are included to further clarify the invention but are not to be construed as limitations on the scope of the invention.

Example 1

A Fisher-Tropsch distillate fraction (designated FTBO-2.5) having a viscosity between 2 and 3 cSt at 100 degrees C. was produced as generally described above, i.e., by the Fischer-Tropsch process, hydrotreating, hydroisomerization dewaxing, hydrofinishing, atmospheric distillation, and vacuum distillation. The properties of FTBO-2.5 were analyzed and its properties compared to two commercially available conventional petroleum derived oils (Nexbase 3020 and Pennzoil 75HC) having viscosities within the same general range. A comparison between the properties of the three samples is shown below:

| | FTBO-2.5 | Nexbase 3020 | Pennzoil 75HC |
|---|---|---|---|
| Viscosity at 100 degrees C. (cSt) | 2.583 | 2.055 | 2.885 |
| Viscosity Index (VI) | 133 | 96 | 80 |
| Pour Point, C. | −30 | −51 | −38 |
| TGA Noack Volatility (wt. percent) | 49 | 70 | 59 |

It should be noted that, although the viscosity at 100 degrees C. of the Fischer-Tropsch derived material was comparable to those of the conventional oils, the VI was significantly higher and the TGA Noack volatility was significantly lower.

Example 2

FTBO-2.5 was blended with two different Medium Neutral petroleum Group I or Group II base oils identified as ChevronTexaco 220R(Group II) and Exxon Europe MN (Group I). The weight percent of FTBO-2.5 in the total blend was selected to provide a kinematic viscosity at 100° C. of approximately 3.9 cSt. The properties of these blends are summarized in Table 3. The excellent cold cranking viscosities of the blends as compared to the conventional 100 Neutral oils with comparable Noack volatilities (shown in Table 5) should be noted.

TABLE 3

| Composition | Blend 1 47% FTBO-2.5/53% ChevronTexaco 220R | Blend 2 56% FTBO-2.5/44% Exxon Europe MN |
|---|---|---|
| D-2887 Simulated TBP (WT %), ° F. | | |
| TBP @ 5 | 627 | 623 |
| TBP @ 10 | 649 | 641 |
| TBP @ 20 | 688 | 674 |
| TBP @ 30 | 722 | 706 |
| TBP @ 50 | 779 | 772 |
| TBP @ 70 | 832 | 830 |
| TBP @ 90 | 910 | 901 |
| TBP @ 95 | 943 | 929 |
| TBP @ 99.5 | 1028 | 974 |
| Boiling Range Distribution (5–95) | 316 | 306 |
| Viscosity at 40° C. | 17.64 | 17.02 |
| Viscosity at 100° C. | 3.956 | 3.884 |
| Viscosity Index | 121 | 123 |
| Pour Point, ° C. | −13 | −13 |
| CCS at −40° C., cP | 4432 | 4337 |
| CCS at −35° C., cP | 2217 | 2152 |
| CCS at −30° C., cP | 1173 | 1137 |
| TGA Noack | 27.84 | 30.15 |
| Oxidator BN, hrs. | 22.38 | 14.79 |

Example 3

FTBO-2.5 was blended with two different Heavy Neutral conventional Group I or Group II base oils identified as ChevronTexaco 600R (Group II) and Exxon Europe HN (Group I). The viscosity and VI for each of the petroleum derived base oils was as follows:

| Petroleum Derived Base Oil | Viscosity @ 100° C. | VI |
|---|---|---|
| ChevronTexaco 600R | 12.37 | 100 |
| Exxon Europe HN | 12.25 | 98 |

The weight percent of FTBO-2.5 blended with the petroleum derived base oils was selected to provide a kinematic viscosity at 100° C. of approximately 3.9 cSt. The properties of these blends are summarized in Table 4.

TABLE 4

| Composition | Blend 3 67.2% FTBO-2.5/32.8% ChevronTexaco 600R | Blend 4 67% FTBO-2.5/33% Exxon Europe HN |
|---|---|---|
| D-2887 Simulated TBP (WT %), ° F. | | |
| TBP @ 5 | 622 | 622 |
| TBP @ 10 | 638 | 638 |

TABLE 4-continued

| Composition | Blend 3 67.2% FTBO-2.5/32.8% ChevronTexaco 600R | Blend 4 67% FTBO-2.5/33% Exxon Europe HN |
|---|---|---|
| TBP @ 20 | 668 | 669 |
| TBP @ 30 | 696 | 698 |
| TBP @ 50 | 756 | 759 |
| TBP @ 70 | 831 | 872 |
| TBP @ 90 | 981 | 982 |
| TBP @ 95 | 1011 | 1009 |
| TBP @ 99.5 | 1061 | 1058 |
| Boiling Range Distribution (5–95) | 389 | 387 |
| Viscosity at 40° C. | 16.6 | 16.5 |
| Viscosity at 100° C. | 3.904 | 3.881 |
| Viscosity Index | 133 | 132 |
| Cloud Point, ° C. | −9 | −10 |
| Pour Point, ° C. | −18 | −13 |
| CCS at −40° C., cP | 3263 | 3640 |
| CCS at −35° C., cP | 1561 | 1751 |
| CCS at −30° C., cP | 852 | 950 |
| TGA Noack | 35.84 | 30.85 |
| Oxidator BN, hrs. | 32.79 | 17.67 |

It will be noted that the VI for Blend 3 was 133 and for Blend 4 was 132. This is a significantly higher value than would have been expected if the VI of the blend components had merely been averaged. In both blends the VI was essentially identical to the VI of the FTBO-2.5. This indicates that the blend benefited from a VI premium. As in the previous example, the excellent CCS results at conventional Noack values makes these oils superior blend stocks.

Example 4

The properties of the lubricating base oils of examples 2 and 3 as shown in Tables 2 and 3 above may be compared to the properties of commercially available petroleum derived conventional Group I and Group II Light Neutral base oils as summarized in Table 5 below.

TABLE 5

| | ChevronTexaco 100R | Gulf Coast Solvent 100 | Gulf Coast H.P. 100 | Exxon Americas Core 100 |
|---|---|---|---|---|
| API Base Oil Category (API 1509 E.1.3) | II | I | II | I |
| D-6352 Simulated TBP (WT %), ° F. | | | | |
| TBP @ 5 | 412 | | | 647 |
| TBP @ 10 | 443 | | | 672 |
| TBP @ 20 | 449 | | | 703 |
| TBP @ 30 | 455 | | | 725 |
| TBP @ 50 | 472 | | | 761 |
| TBP @ 70 | 489 | | | 796 |
| TBP @ 90 | 516 | | | 839 |
| TBP @ 95 | 530 | | | 858 |
| TBP @ 99.5 | 576 | | | 907 |
| Boiling Range Distribution (5–95) | 118 | | | 211 |
| Viscosity at 40° C. | 20.4 | 20.4 | 20.7 | 20.2 |
| Viscosity at 100° C. | 4.1 | 4.1 | 4.1 | 4.04 |
| Viscosity Index | 102 | 97 | 97 | 95 |
| Pour Point, ° C. | −14 | −18 | −15 | −19 |
| CCS at −25° C., cP | 1450 | 1430 | 1550 | 1513 |

TABLE 5-continued

| | ChevronTexaco 100R | Gulf Coast Solvent 100 | Gulf Coast H.P. 100 | Exxon Americas Core 100 |
|---|---|---|---|---|
| CCS at −35° C., cP | >3000 | >3000 | >3000 | >3000 |
| Noack Volatility, wt % | 26 | 29 | 25.5 | 29.3 |

A comparison of Table 3 and 4 with Table 5 illustrates that the Fischer-Tropsch derived lubricating base oils have a similar Noack volatility, pour point, and kinematic viscosity at 100 degrees C. to conventional Group I and Group II Light Neutral oils. The Fischer-Tropsch derived lubricating base oils of the invention also display significantly better VI and lower CCS viscosity than the conventional Light Neutral oils.

Example 5

A crankcase engine oil meeting SAE J300 10W-40 grade viscosity definitions was formulated with a lubricating base oil of this invention. The lubricating base oil contained 12 weight percent FTBO-2.5 with 88 weight percent ChevronTexaco 220R. This base oil was used to prepare the automotive engine oil shown below in Table 6.

TABLE 6

| | Engine Oil |
|---|---|
| SAE Viscosity Grade | 10W-40 |
| Viscosity at 40° C. | 92.68 |
| Viscosity at 100° C. | 13.98 |
| Viscosity Index | 154 |
| CCS @ −25 C. | 4,749 |
| TGA Noack, wt. % loss | 15.41 |
| HTHS, cP | 3.75 |
| Gelation Index | 4.5 |
| Oxidator B, Time to 1L O2/100 g oil, Hrs. | 30.75 |

It should be noted that the blended engine oil was able to meet viscosity, CCS, HTHS, and Gelation Index Specifications for a premium automotive engine oil. The engine oil also demonstrated excellent oxidation stability.

Example 6

A Fischer-Tropsch distillate fraction having a viscosity of 2.2 cSt at 100 degrees C. (designated FTBO-2.2) was blended with Heavy Neutral conventional ChevronTexaco 600R (Group II) and Exxon Europe HN (Group I) to form two lubricating base oil blends as shown in Table 7.

TABLE 7

| Composition | Blend 5 20% FTBO-2.2/80% ChevronTexaco 600R | Blend 6 20% FTBO-2.2/80% Exxon Europe HN |
|---|---|---|
| Viscosity at 40° C. | 51.63 | 52.88 |
| Viscosity at 100° C. | 7.666 | 7.915 |
| VI | 113 | 117 |
| CCS @ −25 C. | 8,609 | 6,780 |

Each blend was formulated into an engine oil meeting the specifications for 15W-30 and 15W-40 by blending in an additive package. A viscosity modifier was added only the 15W-40 blends. No viscosity modifier was added to either 15W-30 blend. The properties of the finished lubricants are shown in Table 8.

TABLE 8

| Grade | Blend 5 15W-30 | Blend 5 15W-40 | Blend 6 15W-30 | Blend 6 15W-40 |
|---|---|---|---|---|
| Viscosity Modifier | None | present | None | present |
| Vis @ 40° C. | 77.91 | 106.5 | 78.72 | 106.5 |
| Vis @ 100° C. | 10.55 | 14.22 | 10.76 | 14.21 |
| VI | 120 | 134 | 123 | 136 |
| Pour Point, ° C. | −32 | −33 | −35 | −35 |
| CCS @ −20 | 7000 | 6,924 | 5,752 | 5,773 |
| Gelation Index | 4.7 | 5.6 | 3.8 | 4 |
| HTHS | 3.27 | 4.01 | 3.36 | 4.02 |
| TGA Noack | 15.12 | 15.47 | 14.72 | 14.94 |

It will be noted that each blend was formulated to meet the specifications for 15W-30 and 15W40. It should also be noted that both blend 5 and Blend 6 were able to meet the VI specification for 15W-30 without the addition of a viscosity modifier.

Example 7

FTBO-2.5 was blended in various proportions with three different conventionally derived bright stocks to yield six different blends. Each blend was analyzed for its properties. The properties of FTBO-2.5 to bright stock and the properties of each blend are shown in Table 9 below.

What is claimed is:

1. A lubricating base oil blend having a viscosity of about 3 cSt or greater at 100 degrees C. consisting essentially of, (a) from about 10 to about 80 weight percent based upon the total blend of a Fischer-Tropsch derived distillate fraction characterized by a viscosity of about 2 cSt or greater but less than 3 cSt at 100 degrees C.; and (b) from about 20 to about 90 weight percent based upon the total blend of a petroleum derived base oil selected from the group consisting of a Group I base oil, a Group II base oil, a Group III base oil, and a mixture of two or more of any of the foregoing conventional base oils.

2. The lubricating base oil blend of claim 1 wherein the Fischer-Tropsch derived distillate fraction has a viscosity between about 2.1 and 2.8 cSt at 100 degrees C.

3. The lubricating base oil blend of claim 2 wherein the Fischer-Tropsch derived distillate fraction has a viscosity between about 2.2 and 2.7 cSt at 100 degrees C.

4. The lubricating base oil blend of claim 1 wherein the TGA Noack volatility is less than about 45 weight percent.

5. The lubricating base oil blend of claim 4 wherein the TGA Noack volatility is greater than about 12 weight percent.

6. The lubricating base oil of claim 1 wherein the pour point is no more than -12 degrees C.

7. The lubricating base oil blend of claim 1 wherein the VI is 90 or greater.

8. The lubricating base oil blend of claim 7 wherein the VI is 100 or greater.

9. The lubricating base oil blend of claim 1 wherein the oxidator BN value is at least 15 hours.

TABLE 9

| Description/Blend ID | Blend 7 | Blend 8 | Blend 9 | Blend 10 | Blend 11 | Blend 12 |
|---|---|---|---|---|---|---|
| FTBO-2.5 (wt. %) | 30 | 60 | 25 | 60 | 30 | 40 |
| Chevron 150 BS (wt. %) | | | | | 70 | 60 |
| IKC BS (wt. %) | 70 | 40 | | | | |
| Daqing BS (wt. %) | | | 75 | 40 | | |
| INSPECTIONS | | | | | | |
| Viscosity @ 40° C. | 88.83 | 28.73 | 77.19 | 26.20 | 92.04 | 56.52 |
| Viscosity @ 100° C. | 12.07 | 5.81 | 11.96 | 5.683 | 11.8 | 9.011 |
| VI | 129 | 150 | 150 | 166 | 119 | 129 |
| Pour Point ° C. | −14 | −18 | −21 | −23 | −9 | −11 |
| CCS @ −25° C. | 14,822 | 1,601 | 8,009 | 1,177 | 20,543 | 7,877 |
| TGA Noack | 15.40 | 31.65 | 14.32 | 31.98 | 15.99 | 21.10 |
| Simulated TBP by D-2887 (wt. %), ° F. | | | | | | |
| TBP @ 0.5 | 609 | 604 | 610 | 603 | 609 | 607 |
| TBP @ 5 | 639 | 624 | 646 | 622 | 639 | 634 |
| TBP @ 10 | 668 | 640 | 680 | 636 | 669 | 659 |
| TBP @ 20 | 729 | 670 | 756 | 664 | 731 | 709 |
| TBP @ 30 | 794 | 699 | 954 | 690 | 800 | 761 |
| TBP @ 40 | 982 | 733 | 1014 | 720 | 977 | 826 |
| TBP @ 50 | 1050 | 766 | 1052 | 750 | 1023 | 1002 |
| TBP @ 60 | 1084 | 802 | 1083 | 782 | 1055 | 1043 |
| TBP @ 70 | 1112 | 1012 | 1114 | 829 | 1081 | 1073 |
| TBP @ 80 | 1141 | 1090 | 1149 | 1048 | 1111 | 1105 |
| TBP @ 90 | 1175 | 1144 | 1189 | 1113 | 1149 | 1145 |
| TBP @ 95 | 1200 | 1177 | 1215 | 1153 | 1175 | 1175 |
| TBP @ 99.5 | 1243 | 1234 | 1264 | 1211 | 1224 | 1223 |

10. The lubricating base oil blend of claim 9 wherein the oxidator BN value is at least 25 hours.

11. The lubricating base oil blend of claim 10 wherein the oxidator BN value is at least 30 hours.

12. The lubricating base oil blend of claim 1 wherein the boiling range distribution is greater than 250 degrees F. between the 5 percent and 95 percent points as measured by analytical method D-6352 or its equivalent.

13. The lubricating base oil blend of claim 12 wherein the boiling range distribution is greater than 350 degrees F. between the 5 percent and 95 percent points as measured by analytical method D-6352 or its equivalent.

14. The lubricating base oil blend of claim 1 wherein the petroleum derived base oil includes brightstock.

15. The lubricating base oil blend of claim 14 wherein the boiling range distribution is greater than 450 degrees F. between the 5 percent and 95 percent points as measured by analytical method D-6352 or its equivalent.

16. The lubricating base oil blend of claim 1 which is suitable for preparing a mono-grade crankcase engine oil.

17. The lubricating base oil blend of claim 1 which is suitable for preparing a multi-grade crankcase engine oil.

* * * * *